US011440154B2

(12) United States Patent
Hashimotodani et al.

(10) Patent No.: US 11,440,154 B2
(45) Date of Patent: Sep. 13, 2022

(54) SYSTEM AND METHOD FOR POLISHING METAL SURFACE

(71) Applicant: Samtech International, Inc., Carson, CA (US)

(72) Inventors: Naoki Hashimotodani, Torrance, CA (US); Masahiko Fumimoto, Torrance, CA (US); Huu Minh Nguyen, Westminster, CA (US)

(73) Assignee: Samtech International, Inc., Carson, CA (US)

( * ) Notice: Subject to any disclaimer, the term of this patent is extended or adjusted under 35 U.S.C. 154(b) by 945 days.

(21) Appl. No.: 16/186,401

(22) Filed: Nov. 9, 2018

(65) Prior Publication Data

US 2019/0160621 A1 May 30, 2019

Related U.S. Application Data

(60) Provisional application No. 62/591,645, filed on Nov. 28, 2017.

(51) Int. Cl.
*B24B 5/40* (2006.01)
*B24B 39/02* (2006.01)
(Continued)

(52) U.S. Cl.
CPC ..... *B24B 5/40* (2013.01); *B24B 5/185* (2013.01); *B24B 31/006* (2013.01); *B24B 39/02* (2013.01)

(58) Field of Classification Search
CPC .. B24B 5/06; B24B 5/10; B24B 5/185; B24B 5/363; B24B 5/40; B24B 5/428;
(Continued)

(56) References Cited

U.S. PATENT DOCUMENTS 2,346,861 A * 4/1944 Montgomery ..... B24B 5/40 451/51
2,405,476 A * 8/1946 Weatherhead, Jr. .... F16K 1/482 403/119
(Continued)

FOREIGN PATENT DOCUMENTS

GB 2208069 A * 2/1989 ..... B24B 5/40

*Primary Examiner* — Tyrone V Hall, Jr.
*Assistant Examiner* — Makena S Markman
(74) *Attorney, Agent, or Firm* — LambentIP

(57) ABSTRACT

This document discloses a system and method for polishing a metal surface, using a grinding machine and a burnishing machine. The grinding machine comprises an arm coupled with a grinding wheel for grinding the internal surface of a workpiece, an arm rotation drive block configured to drive rotation of the arm around its longitudinal axis, an arm movement drive block configured to move the arm longitudinally and vertically, and rollers for rotating the workpiece around its cylindrical axis via friction with an external surface of the workpiece. The arm comprises a fixed main shaft, a universal joint shaft and a head section coupled with the grinding wheel, wherein the head section is configured to oscillate vertically, allowing the grinding wheel to follow up-and-down fluctuations of the workpiece. The burnishing machine is configured to tumble the workpiece including a tumbling detergent and tumbling beads therein.

16 Claims, 10 Drawing Sheets

(51) Int. Cl.
*B24B 31/00* (2006.01)
*B24B 5/18* (2006.01)

(58) Field of Classification Search
CPC ..... B24B 41/005; B24B 41/002; B24B 41/02; B24B 41/007; B24B 41/04; B24B 41/042; B24B 41/067; B24B 41/0475; B24B 47/10; B24B 31/00; B24B 31/006; B24B 31/02; B24B 31/0212; B24B 31/0224; B24B 31/14; B24B 39/003; B24B 39/02; B24B 33/025
USPC ..... 451/34, 27, 51, 61, 381
See application file for complete search history.

(56) References Cited

U.S. PATENT DOCUMENTS

| | | | | | |
|---|---|---|---|---|---|
| 2,621,449 | A * | 12/1952 | Martin | B24B 21/002 | 451/121 |
| 3,131,517 | A * | 5/1964 | Townsend | B24B 5/10 | 451/27 |
| 4,229,908 | A * | 10/1980 | Panzeri | B24B 19/02 | 15/104.096 |
| 5,111,623 | A * | 5/1992 | Lehmann | B24B 5/40 | 451/159 |
| 9,022,837 | B2 * | 5/2015 | Pohlitz | B24B 33/105 | 451/210 |
| 2008/0102733 | A1 * | 5/2008 | Harter | B24B 47/16 | 451/5 |
| 2016/0339558 | A1 * | 11/2016 | Twelves, Jr. | B24B 31/10 | |

* cited by examiner

SYSTEM AND METHOD FOR POLISHING METAL SURFACE

CROSS REFERENCE TO RELATED APPLICATIONS

This application claims the benefit of U.S. provisional application Ser. No. 62/591,645, filed on Nov. 28, 2017.

BACKGROUND

High-precision polishing of metal surfaces is often required for various mechanical parts in products to enhance the quality and performance. In particular, tight requirements are imposed on the fabrication of high-pressure gas cylinders such as aluminum liners, for example, in aerospace engineering applications, so as to achieve extremely low surface roughness for safety and durability reasons.

In view of the increasingly demanding requirements for ever smoother metal surfaces of various mechanical parts deployed in aerospace and other high-technology areas, a comprehensive system and method are urgently needed to achieve extremely low surface roughness with high efficiency and sustained throughput.

DETAILED DESCRIPTION

In view of the increasingly demanding requirements for ever smoother metal surfaces of various mechanical parts deployed in aerospace and other high-technology areas, this document describes a comprehensive system and method configured to grind and burnish an internal surface of a metal workpiece. The system may comprise a first module and a second module, wherein the first module may be a grinding machine and the second module may be a burnishing machine for refining the surface pre-ground by the grinding machine. Details of the present system and method for polishing a metal surface are explained below with reference to accompanying drawings.

Figure 1A:
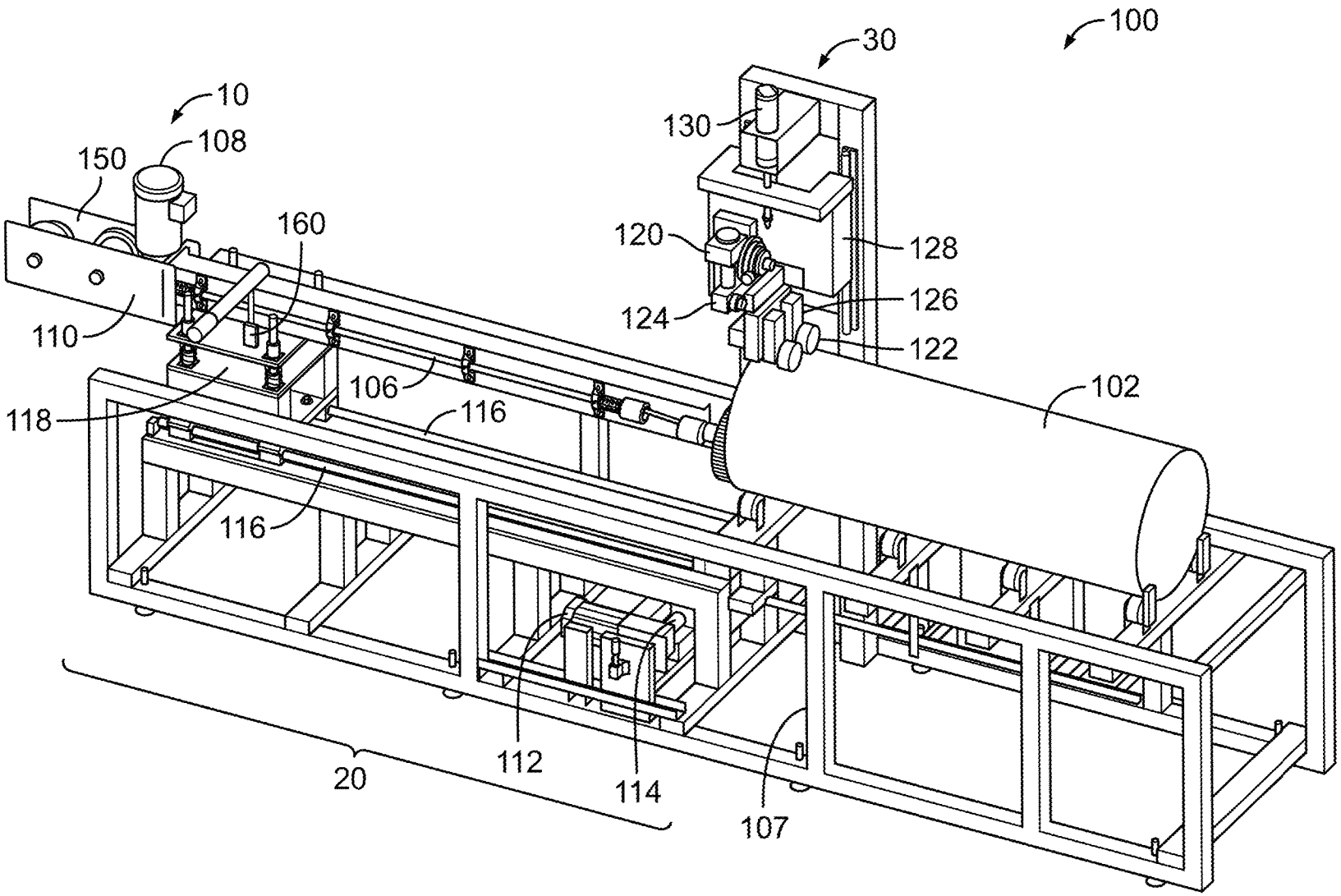
FIGS. 1A and 1B are a perspective view and a side view, respectively, illustrating the grinding machine of the present system, according to an embodiment.
Figure 1B:
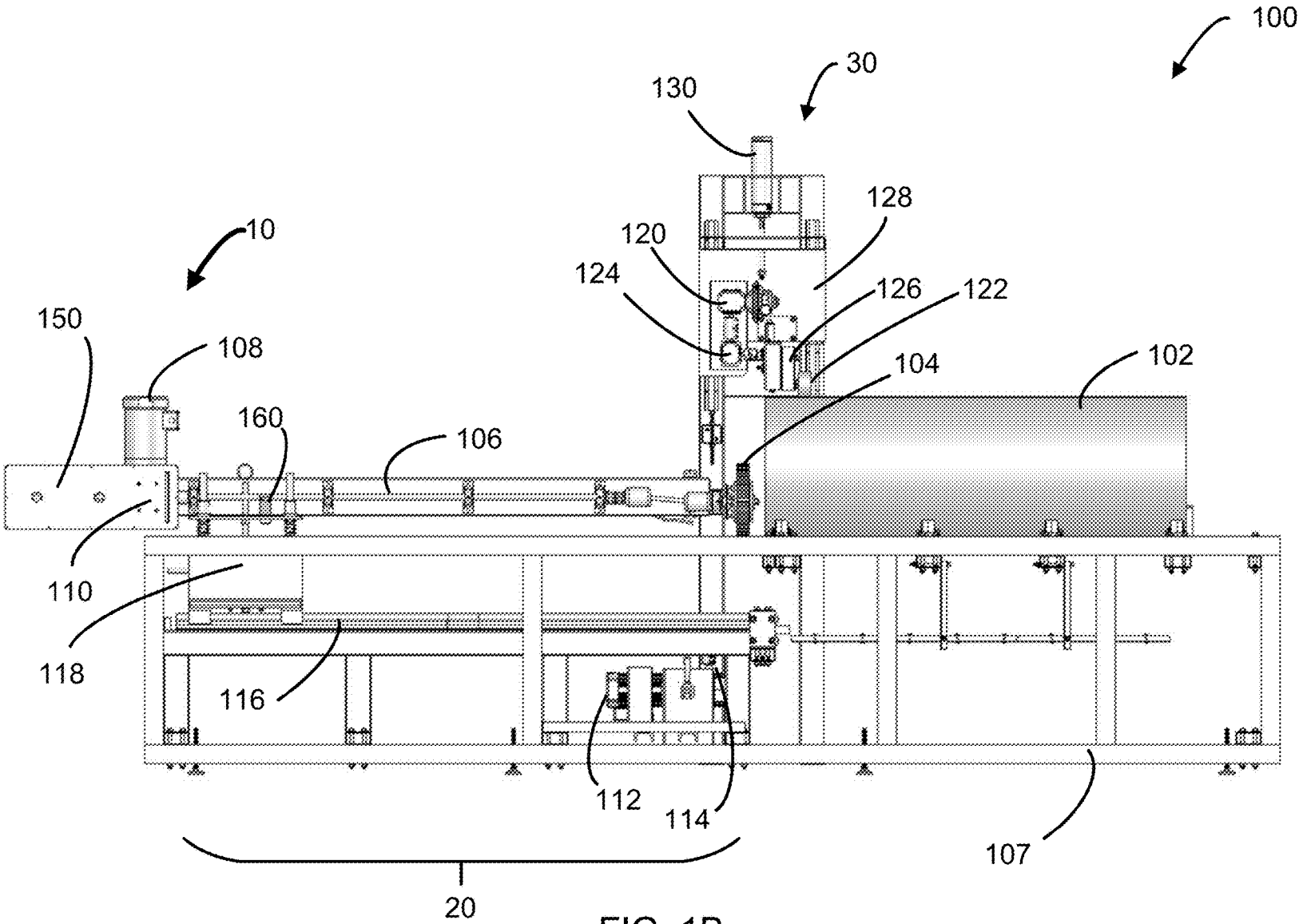

FIGS. 1A and 1B are a perspective view and a side view, respectively, illustrating the grinding machine 100 of the present system, according to an embodiment, wherein a workpiece 102 is mounted on the grinding machine 100. The workpiece 102 in these figures is illustrated to have a shape of a hollow cylinder with a fixed diameter along the cylindrical axis, being mounted horizontally on the grinding machine 100. However, the grinding machine 100 can be configured to operate on a workpiece formed to be any generally cylindrical shell having a generally hollow cylindrical shape with internal and external diameters, each of which can be fixed or varying along the cylindrical axis.

A grinding wheel 104 (inserted inside the workpiece 102 and so not shown in FIG. 1A, but shown in FIG. 1B) is coupled with one end portion of an arm 106. The grinding wheel 104 has a generally disk shape, disposed transversely with respect to the arm 106. The arm 106 includes a rod extending along the longitudinal axis. A table specifically designed for mounting the workpiece 102 may be included in the structure of the grinding machine 100, by coupling the table to a frame 107 of the grinding machine 100. In the configuration shown in FIGS. 1A and 1B, the workpiece 102 having a generally cylindrical shell is placed horizontally on the table, and the arm 106 extends along its longitudinal axis that is in parallel with the cylindrical axis of the workpiece 102 mounted on the grinding machine 100. Thus, the longitudinal direction of the arm 106 is generally along the cylindrical axis of the workpiece 102, hence the horizontal direction in this configuration. The grinding wheel 104 includes a generally ring-shaped grinding media around its periphery. The grinding media is brought into contact with the internal surface of the workpiece 102 for the grinding operation. Many types of materials are available for use as the grinding media, each material having its own specific properties and advantages. An example of the grinding media may include an unwoven fabric. The generally ring-shaped grinding media, which is part of the grinding wheel 104, can be configured to be detachably attached with the grinding wheel 104 and thus replaceable, by means of fasteners, adhesives, etc.

An arm rotation drive block 10 is coupled with the arm 106 at the other end portion opposite to the one end portion attached with the grinding wheel 104, for driving the rotation of the arm 106 around its longitudinal axis, hence the rotation of the grinding wheel 104. The arm rotation drive block 10 includes a first motor 108 as a power source for driving the rotation of the arm 106. The arm rotation drive block 10 may further include a first speed adjuster 110 (not shown, behind the cover labeled 110 in FIGS. 1A and 1B), which may be coupled between the first motor 108 and the arm 106. An example of the first speed adjuster 110 may include a gear reducer for changing the rotation speed from the first motor 108 to the arm 106.

An arm movement drive block 20 is coupled with the arm 106 for driving the longitudinal and vertical movements of the arm 106. Here, the longitudinal movement is the horizontal movement of the arm 106 along its axis in the present configuration in FIGS. 1A and 1B, hence the longitudinal movement of the grinding wheel 104 attached to the arm 106; and the vertical movement is the vertical up-and down movement of the arm 106 in the present configuration in FIGS. 1A and 1B, hence the vertical movement of the grinding wheel 104 attached to the arm 106.

The arm movement drive block 20 includes a second motor 112 as a power source for driving the longitudinal movement. The arm movement drive block 20 may further include a linear actuator 114 coupled to the second motor 112 for converting the rotational motion from the second motor 112 to the linear motion. An example of the linear actuator 114 may include a rack and pinion, which comprises a circular gear called a pinion engaging teeth on a linear gear bar called a rack, thereby converting the rotational motion of the pinion into a linear motion of the rack. In the configuration illustrated in FIGS. 1A and 1B, the linear actuator 114 comprises a rack and pinion, wherein the rack continues from the pinion to extend along the longitudinal direction (not shown, behind one of horizontal beams of the frame 107.) Alongside the rack, a slide 116 is configured for an arm support 118 to slide longitudinally. In this example, the slide 116 has two rails elongated along two sides of the rack. The arm support 118 is configured to hold the arm 106 at the other end portion opposite to the one end portion attached with the grinding wheel 104, having multiple legs at a bottom portion to engage with and slide along the two rails of the slide 116 so that the arm 106 moves longitudinally at a predetermined speed while driven by the second motor 112. The speed may be predetermined, for example, to be 25 mm/revolution while the rotation speed of the grinding wheel 104 is 150 rpm and the rotation speed of the workpiece 102 is 1.2 rpm. Obviously, the speeds optimal for grinding operation depend on the diameter of the workpiece 102, the diameter and type of the grinding media and various other factors, and may be determined experimentally or by simulations, for example.

The arm movement drive block 20 is further configured to adjust the vertical position (height) of the arm 106, hence the vertical position (height) of the grinding wheel 104 attached to the arm 106. A jack 119 (not shown, behind one of the panels of the arm support 118 in FIGS. 1A and 1B, shown later in FIG. 4) and its peripheral parts such as a handle, screws, etc. may be coupled with the arm 106, via the arm support 118, for adjusting the vertical position of the arm 106. The height adjustment may be done manually using the handle associated with the jack 119 to adjust the height of the arm support 118, hence the vertical position of the arm 106. An example of the jack 119 may include a hydraulic jack.

A roller system 30 is configured to include a third motor 120 as a power source for driving the rotations of one or more rollers 122 around their respective axes, hence the rotation of the workpiece 102 when the one or more rollers 122 are in contact with the workpiece 102. That is, the one or more rollers 122 are configured to rotate the workpiece 102 around its cylindrical axis via friction between the one or more rollers 122 and the external surface of the workpiece 102. An example of the third motor 120 may include a pneumatic motor. The use of a pneumatic motor such as an air motor may be preferable to using an electric motor, since less sparks with metal particles can be generated during the grinding operation of the metal workpiece 102. Each of the one or more rollers 122 may be a foam roller including a generally ring-shaped foam around its periphery, which is brought into contact with the external surface of the workpiece 102. Many types of materials are available for use as the foam, each material having its own specific properties and advantages. The one or more rollers 122 in the present grinding machine 100 are configured to rotate the workpiece 102 around its axis when the one or more rollers 122 are brought into contact with the external surface of the workpiece 102; therefore, the foam material should be elastic and provide sufficient friction with minimal slippage. An example of the foam material may include urethane. The generally ring-shaped foam, which is part of the roller 122, can be configured to be detachably attached with the roller 122 and replaceable by means of fasteners, adhesives, etc. A second speed adjuster 124 may be coupled between the third motor 120 and the one or more rollers 122. An example of the second speed adjuster 124 may include a gear reducer for decreasing the speed from a rotating power source, which is the third motor 120, to the one or more rollers 122. In addition to going through the second speed adjuster 124, the rotational energy provided by the third motor 120 may be conveyed to the one or more rollers 122 via a set of pulleys and belts included in a conveying device 126, which may be coupled between the second speed adjuster 124 and the one or more rollers 122.

A roller support 128 is included in the roller system 30 to support and hold the rollers 122 and the other parts and to slide vertically on the vertically formed rails. The vertical positioning of the roller support 128, hence the vertical positioning of the one or more rollers 122, can be adjusted by a pneumatic cylinder 130, which may be disposed above the roller support 128. The pneumatic cylinder 130 such as an air cylinder uses the power of compressed gas or air to produce a force to move the roller support 128 in a reciprocating linear motion. Thus, the roller system 30 includes the pneumatic cylinder 130 to adjust the vertical position (height) of the one or more rollers 122, by providing the vertical force for the roller support 128 to slide vertically on the vertically formed rails. Based on the vertical adjustment, the foam material of the one or more rollers 122 can be brought into contact with the external surface of the workpiece 102 to achieve optimal pressure and friction, thereby achieving efficient rotation of the workpiece 102.

Figure 2A:
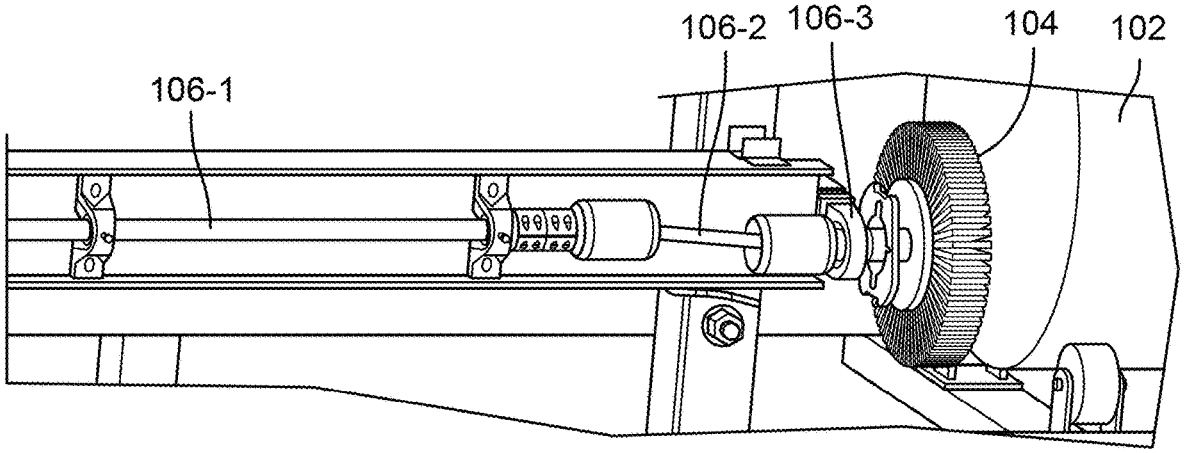
FIGS. 2A and 2B are an expanded perspective view looking from the front side and an expanded perspective view looking from the rear side, illustrating one end portion of the arm attached with the grinding wheel.
Figure 2B:
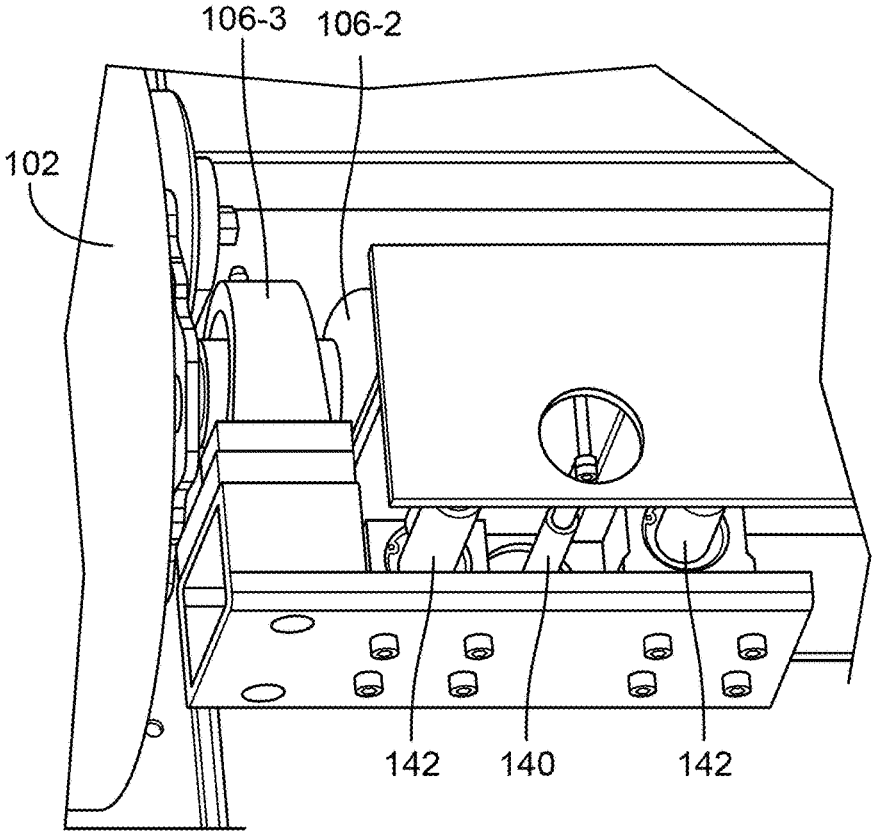

Details of the mechanism of the arm 106 are explained below with reference to FIGS. 2A and 2B, which are an expanded perspective view looking from the front side and an expanded perspective view looking from the rear side, illustrating one end portion of the arm 106 attached with the grinding wheel 104. As explained with reference to FIGS. 1A and 1B, the other end portion of the arm 106 is coupled with the arm rotation drive block 10 and the arm support 118. In FIG. 2B, the grinding wheel 104 cannot be seen because it is obscured by the workpiece 102 in this configuration. In the present grinding machine 100, the arm 106 comprises three parts: a main shaft 106-1, a universal joint shaft 106-2 and a head section 106-3. The main shaft 106-1 is fixed with the arm support 118 that is configured to support and carry the arm 106 longitudinally as driven by the second motor 112 as well as to support and position the arm 106 vertically as adjusted by the jack 119 (behind one of the panels of the arm support 118 in FIGS. 1A and 1B, shown later in FIG. 4). The universal joint shaft 106-2 couples the main shaft 106-1 and the head section 106-3. The universal joint shaft 106-2 uses two universal joints connected by an intermediate shaft, wherein a universal joint generally refers to a joint or coupling of two rigid rods whose axes are inclined to each other, being used to transmit rotational motion. The head section 106-3 is coupled with the grinding wheel 104, which includes the grinding media at its periphery.

A spring 140 and a linear slide 142, each of which can be one or more, are coupled with the head section 106-3. An example of the spring 140 may include a gas spring, as illustrated in FIG. 2B. A linear slide, also called a linear-motion bearing is a bearing designed to provide free motion in one direction. Accordingly, the head section 106-3 can oscillate vertically due to the coupling with the universal shaft 106-2, the spring 140 and the linear slide 142, while the main shaft 106-1 is fixed with the arm support 118 on the first slide 116. Thus, the combinational use of at least the universal joint shaft 106-2, the spring 140 and the linear slide 142 allows the head section 106-3, hence the grinding wheel 104, to follow the up-and-down fluctuations of the workpiece 102 during operation, so as to follow the vertical fluctuations of the internal surface of the workpiece 102, thereby reducing the generation of unwanted bumps, roughness and unevenness of the internal surface of the workpiece 102.

Figure 3:
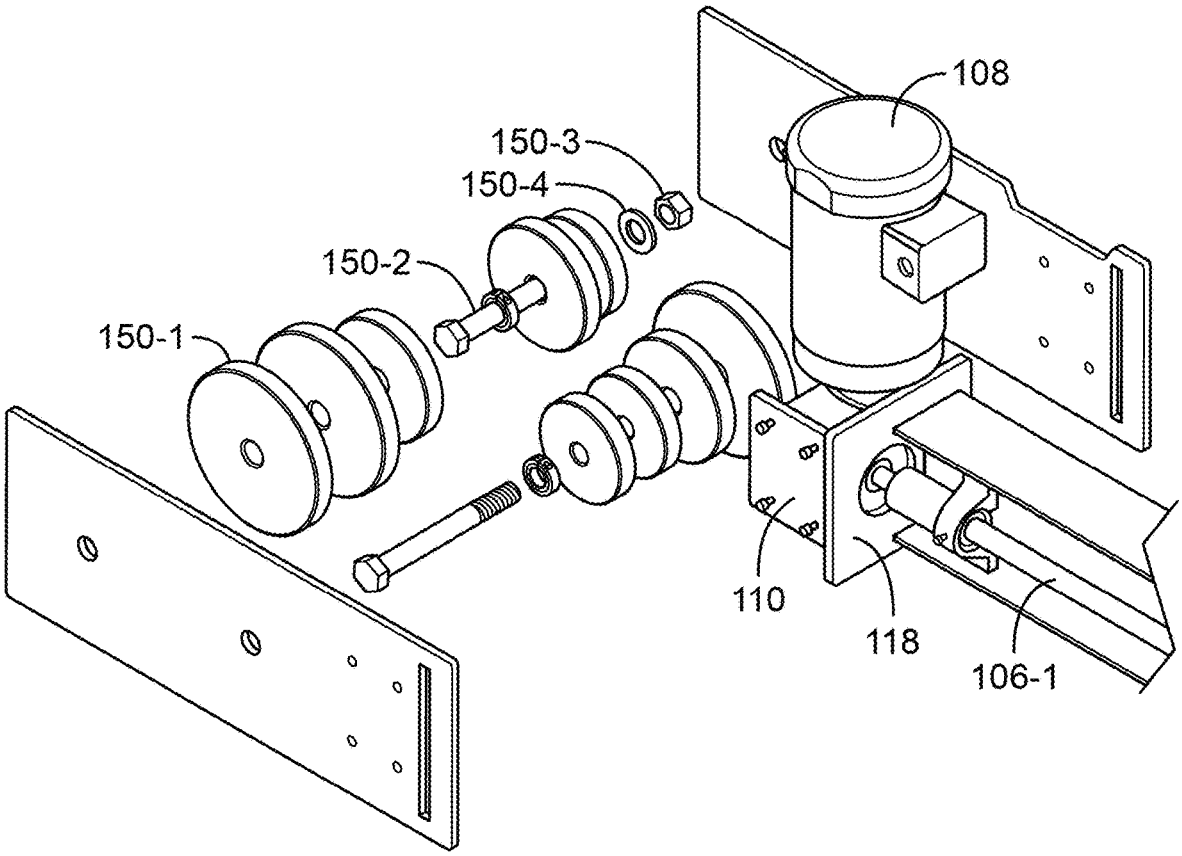
FIG. 3 is an exploded perspective view, expanded around the counter-weight adjusting block, including the end portion of the main shaft coupled with the first motor and the first speed adjuster.

The present system may accommodate an additional measure to enhance the precision of the vertical oscillation of the grinding wheel 104 to follow the up-and-down fluctuations of the workpiece 102. The grinding machine 100 illustrated in FIGS. 1A and 1B includes an example of such a measure, which is a counter-weight adjusting block 150 (the weights partially shown, behind one of the panels of the counter-weight adjusting block 150 in FIG. 1A) coupled with the arm support 118 on the first slide 116. FIG. 3 is an exploded perspective view, expanded around the counter-weight adjusting block 150, including the end portion of the main shaft 106-1 coupled with the first motor 108 and the first speed adjuster 110. The counter-weight adjusting block 150 includes a plurality of weights 150-1, the total weight of which can be manually adjusted prior to the grinding operation by removing, adding and/or changing the weights. The optimal total weight can be determined experimentally. In this example, one or more bolts 150-2, one or more nuts 150-3, one or more washers 150-4 and other fastening parts are included in the counter-weight adjusting block 150 to be used for adjusting the total weight. The weight exerted at the portion of the arm support 118, the portion holding the main shaft 106-1, helps enhance the stability of the main shaft 106-1. Therefore, based on the more stably fixed main shaft 106-1, the precision of the vertical oscillation of the grinding wheel 104 is further enhanced to follow the up-and-down fluctuations of the workpiece 102.

Figure 4:
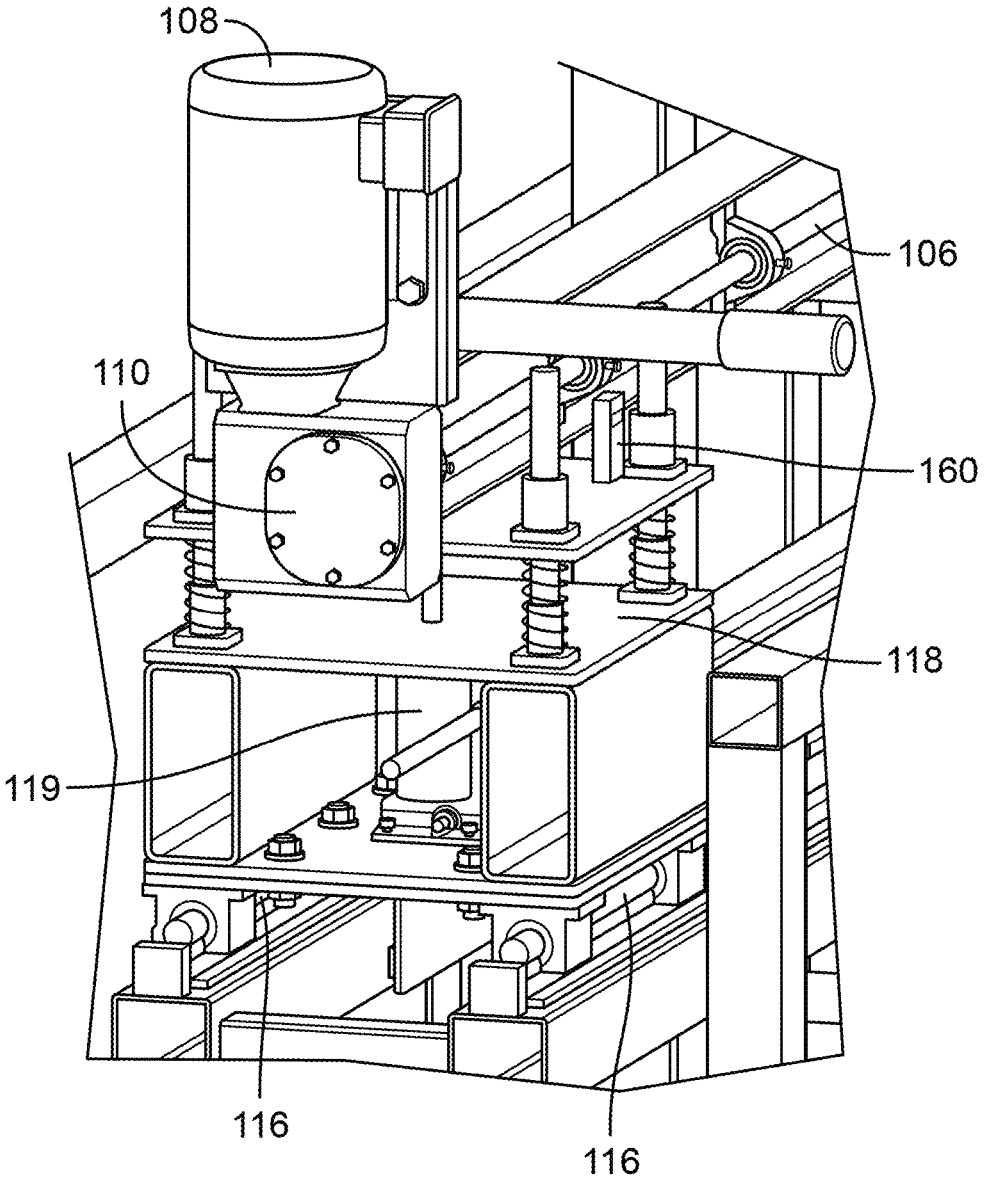
FIG. 4 is an expanded perspective view looking from the front, showing the portion including the jack and the height gage.

FIG. 4 is an expanded perspective view looking from the front, showing the portion including the jack 119 and a height gage 160, which is mounted on one of the horizontal plates of the arm support 118. The counter-weight adjusting block 150 is omitted from this figure for clarity. An example of the height gage 160 may include a digital height gauge. Fine-adjustments of the vertical positioning of the arm 106 can be carried out by using the height gage 160. That is, the vertical position of the grinding wheel 104 with respect to the internal surface of the workpiece 102 can be further adjusted by further adjusting the vertical position of the arm 106 by using the jack 119, until the height gage 160 shows a predetermined vertical shift from the base position. The amount of an optimal vertical shift that enables the grinding media to apply an optimal pressure onto the internal surface of the workpiece 102 may be predetermined experimentally or by simulations, depending on the dimensions of the workpiece 102, the material used for the grinding media of the grinding wheel 104, and other factors.

Figure 5A:
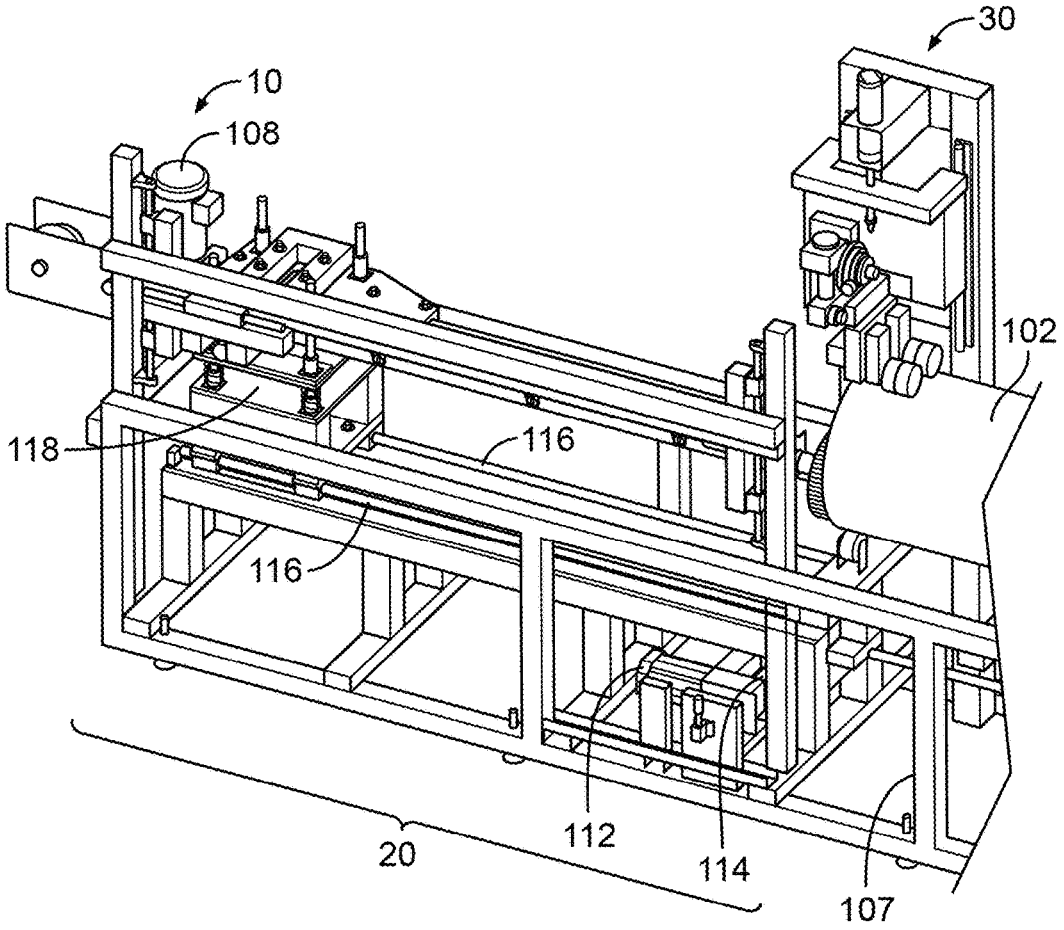
FIG. 5A is an expanded perspective view, illustrating the portion of the grinding machine including the reinforcement.
Figure 5B:
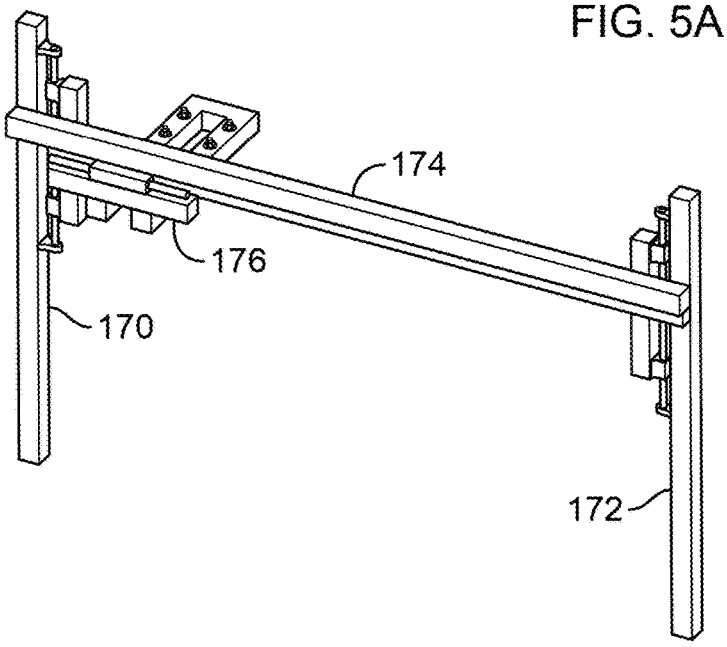
FIG. 5B illustrates the added portion for the reinforcement with respect to the basic sliding means used in the example configuration illustrated in FIGS. 1A and 1B.

Additionally or alternatively to the counter-weight adjusting block 150, the stability of the main shaft 106-1 can be further enhanced by reinforcing the sliding means for the longitudinal advancement of the arm support 118 while driven by the arm movement drive block 20. FIG. 5A is an expanded perspective view, illustrating the portion of the grinding machine 100 including the reinforcement. FIG. 5B illustrates the main added portion of the reinforcement with respect to the basic sliding means used in the example configuration illustrated in FIGS. 1A and 1B. The reinforcement includes multiple vertical beams 170 and 172 attached to the frame 107. A horizontal beam 174, which is along the longitudinal direction, is configured to cross the vertical beams 170 and 172 and move vertically. A support attachment 176 is coupled to the arm support 118. The combination of the arm support 118 and the support attachment 176 is configured to hold and support the arm 106. The horizontal beam 174 is coupled to the support attachment 176; thus, the vertical positioning of the arm support 118, the support attachment 176 and the horizontal beam 174 is together adjusted by the jack 119. Furthermore, the support attachment 176, which can be now considered to be a part of the arm support 118, includes multiple legs at a top portion to engage with and slide along the horizontal beam 174. In this configuration, the horizontal beam 174 is configured to be a third rail in addition to the two rails of the slide 116, which are disposed alongside the rack of the linear actuator 114, shown in FIGS. 1A, 1B and 4. It is possible to add the fourth rail or more for optimal reinforcement. Therefore, the present grinding machine 100 can be configured to include the slide 116 comprising two or more longitudinally-formed rails for the arm support 118 to engage with and slide along longitudinally. The multiple number of rails further enhance the stability of the main shaft 106-1, which is held by the arm support 118 including the support attachment 176, thereby enhancing the precision of the vertical oscillation of the grinding wheel 104 with respect to the more stably fixed main shaft 106-1, to follow the up-and-down fluctuations of the workpiece 102.

Figure 6B:
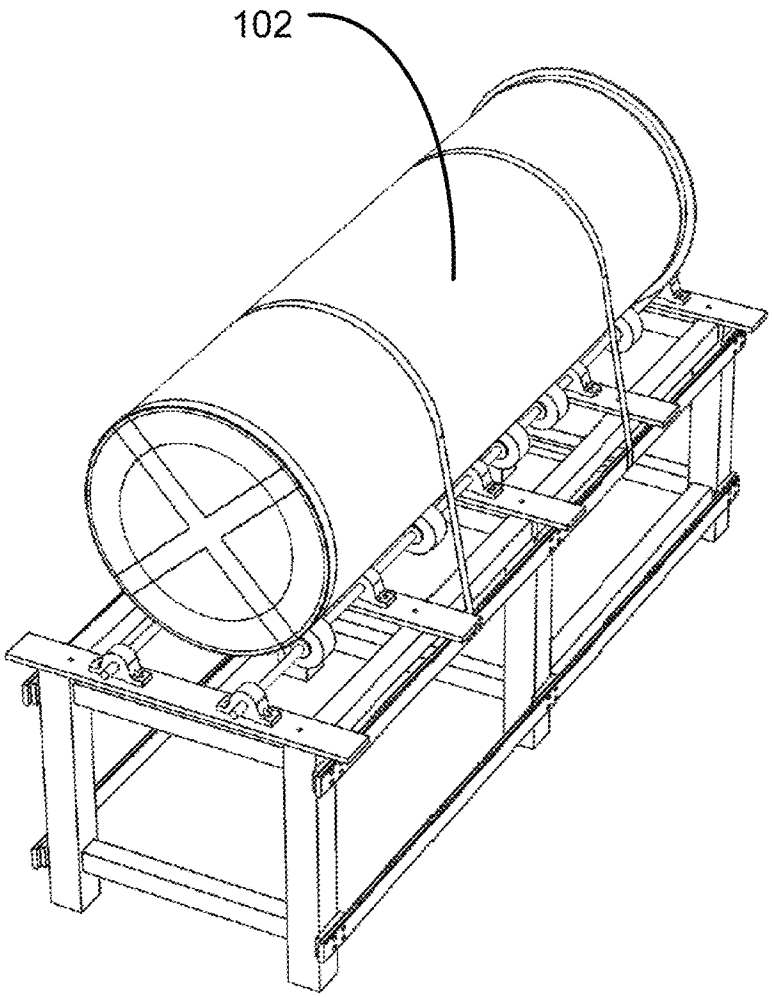
FIG. 6B is a photo showing the workpiece mounted on the tumbling machine.
Figure 6A:
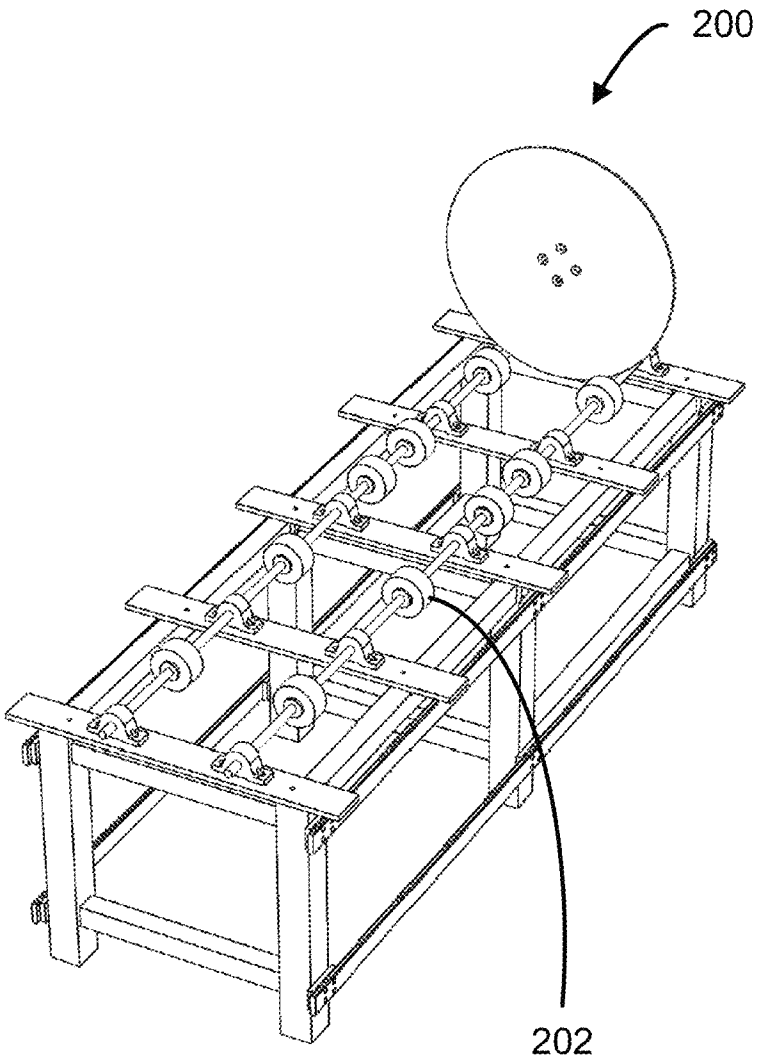
FIG. 6A is a photo showing an example of the burnishing machine, which is configured to be a tumbling machine.

As mentioned earlier, the present system may comprise a first module and a second module, wherein the first module may be a grinding machine and the second module may be a burnishing machine for refining the surface pre-ground by the grinding machine. FIG. 6A is a photo showing an example of the burnishing machine, which is configured to be a tumbling machine 200. FIG. 6B is a photo showing the workpiece 102 mounted on the tumbling machine 200, wherein the internal surface of the workpiece 102 has been pre-ground by using the grinding machine 100. The tumbling machine 200 comprises a plurality of rollers 202 for rotating the workpiece 102 around its axis. The rotation of the plurality of rollers 202 may be driven by a mechanism including a motor, transmission shafts and chains coupling the transmission shafts and the plurality of rollers 202, as can be configured by one with ordinary skill in the art. Tumbling beads and a tumbling detergent are put inside the workpiece 102, which has a shape of a generally cylindrical shell, i.e., a generally hollow cylinder, and the two end openings of the hollow cylinder are covered and sealed by plastic covers in this example. The tumbling beads may be ceramic, and each bead may have a generally spherical shape with a diameter of less than 5 mm. The tumbling detergent may be a liquid acidic compound mixed with water. The tumbling action with the beads and detergent that are internally deposited can thus be carried out to burnish the internal surface of the workpiece 102.

Figure 7:
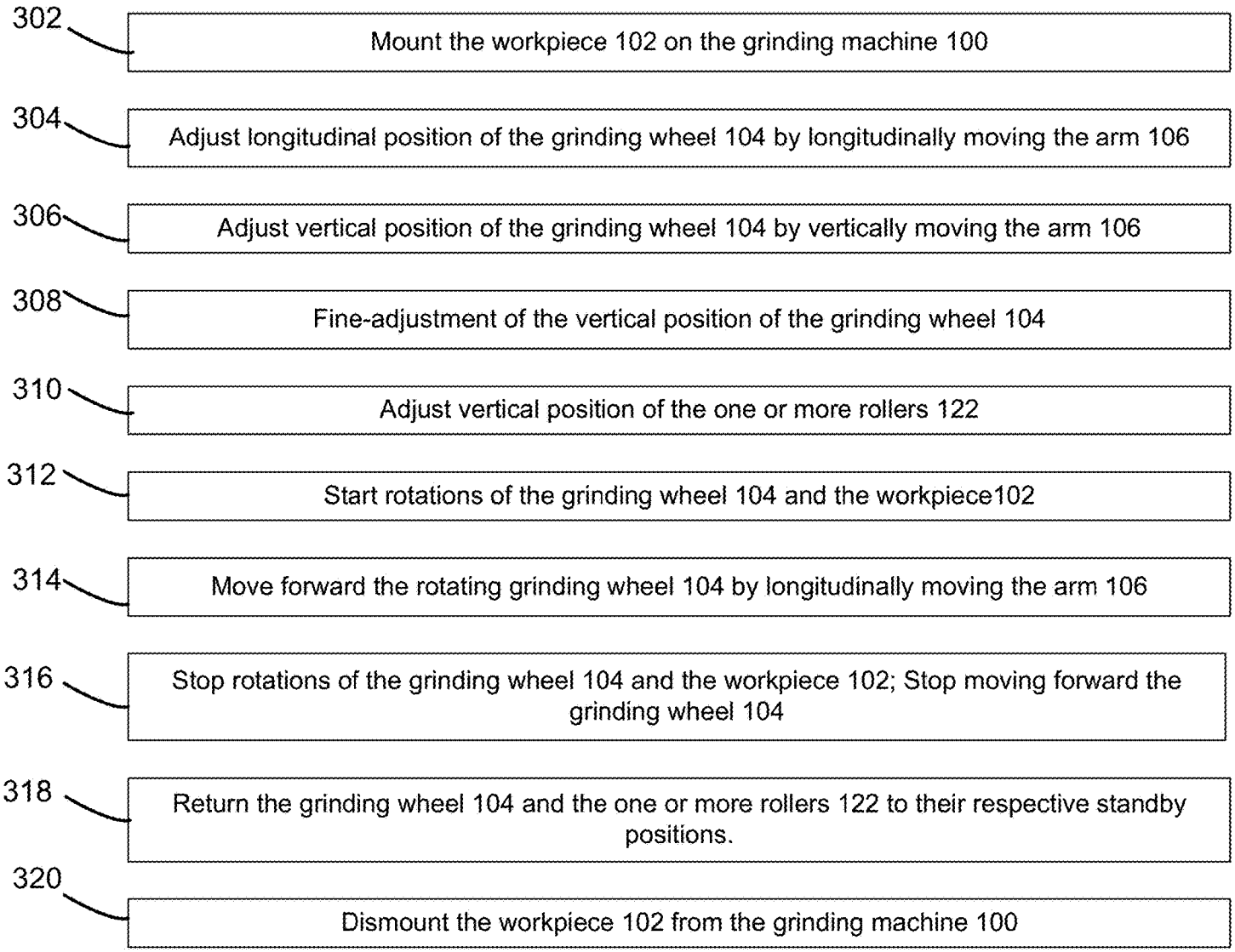
FIG. 7 is a flowchart illustrating an example process of grinding an internal surface of the workpiece by using the grinding machine, according to an embodiment.

FIG. 7 is a flowchart illustrating an example process of grinding an internal surface of the workpiece 102, by using the grinding machine 100, according to an embodiment. The order of steps in the flowcharts illustrated in this document may not have to be the order that is shown, unless otherwise specified. Some steps can be interchanged or sequenced differently depending on efficiency of operations, convenience of applications or any other scenarios. The grinding operation is started in step 302 by mounting the workpiece 102 on the grinding machine 100. A table specifically designed for mounting the workpiece 102 may be included in the structure of the grinding machine 100. In the configuration shown in FIGS. 1A and 1B, the workpiece 102 having a generally cylindrical shell is placed horizontally on the table, and the arm 106 extends along its longitudinal axis that is in parallel with the cylindrical axis of the workpiece 102 mounted on the grinding machine 100. Thus, the longitudinal direction of the arm 106 is generally along the cylindrical axis of the workpiece 102, hence the horizontal direction in this configuration.

In step 304, the longitudinal position of the grinding wheel 104 with respect to the edge of the workpiece 102 is adjusted. For example, the grinding wheel 104 may be positioned at about 5 cm inward from the edge of the workpiece 102. This longitudinal positioning can be carried out manually or by longitudinally moving the arm 106 by running the second motor 112 coupled with the linear actuator 114, which are included in the arm movement drive block 20. As mentioned earlier with reference to FIGS. 1A and 1B, the linear actuator 114 may be a combination of a rack and pinion.

In step 306, the vertical position of the grinding wheel 104 with respect to the internal surface of the workpiece 102 is adjusted. The target vertical position (base position) may be a position that makes the circumference of the grinding media contact the lowest part of the cylindrical internal surface of the workpiece 102. The jack 119 (not shown, behind one of the panels of the arm support 118 in FIGS. 1A and 1B, shown in FIG. 4), such as a hydraulic jack, in the arm movement drive block 20 may be used to adjust the vertical position of the arm 106 attached with the grinding wheel 104. This may be carried out by manually operating the handle associated with the jack 119 to adjust the height of the arm support 118, hence the vertical position of the arm 106.

The pressure applied by the grinding media of the grinding wheel 104 onto the internal surface of the workpiece 102 is determined by the vertical positioning of the grinding wheel 104, thereby being one of the important factors for achieving a high-quality surface grinding. In step 308, fine adjustment of the vertical position of the grinding wheel 104 is carried out. An example procedure for this step 308 may use the height gauge 160 coupled with the arm support 118, wherein the vertical position of the grinding wheel 104 with respect to the internal surface of the workpiece 102 is further adjusted by further adjusting the vertical position of the arm 106 by using the jack 119 to further adjust the height of the arm support 118, until the height gage 160 shows a predetermined vertical shift from the base position, which may be determined in the previous step 306. The amount of an optimal vertical shift that enables the grinding media to apply an optimal pressure onto the internal surface of the workpiece 102 may be predetermined experimentally or by simulations, depending on the dimensions of the workpiece 102, the material used for the grinding media of the grinding wheel 104 and various other factors.

In step 310, the vertical position of the one or more rollers 122 with respect to the external surface of the workpiece 102 is adjusted. The rollers 122 need to be firmly in contact with the external surface of the workpiece 102 with good friction so as to rotate the workpiece 102 with minimal slippage. As mentioned earlier with reference to FIGS. 1A and 1B, the one or more rollers 122 may be installed with the roller support 128, which is configured to slide vertically on the vertically formed rails. The vertical position of the roller support 128, hence the vertical position of the one or more rollers 122, can be adjusted by the pneumatic cylinder 130, which may be disposed above the roller support 128. The pneumatic cylinder 130 such as an air cylinder uses the power of compressed gas or air to produce a force in a reciprocating linear motion.

In step 312, respective rotations of the grinding wheel 104 and the workpiece 102 are started. As described earlier with reference to FIGS. 1A and 1B, the first motor 108 in the arm rotation drive block 10 is coupled with the arm 106, at the end portion opposite to the one end portion attached with the grinding wheel 104, for driving the rotation of the arm 106 around its axis, hence the rotation of the grinding wheel 104. Also, as described earlier with reference to FIGS. 1A and 1B, the third motor 120 in the roller system 30, such as a pneumatic motor, is coupled with the one or more rollers 122 for driving the rotation of the one or more rollers 122, hence the rotation of the workpiece 102 in contact with the one or more rollers 120.

In step 314, the grinding wheel 104 is moved forward at a predetermined speed by longitudinally moving the arm, while both the grinding wheel 104 and the workpiece 102 are rotating. This longitudinal advancement of the grinding wheel 104 can be carried out by longitudinally moving the arm 106 by running the second motor 112 coupled with the linear actuator 114 to let the arm support 118 slide along the slide 116. The slide 116 may include two or more longitudinally formed rails, along which the arm support 118 is configured to stably slide. The speed may be predetermined, for example, to be 25 mm/revolution while the rotation speed of the grinding wheel 104 is 150 rpm and the rotation speed of the workpiece 102 is 1.2 rpm. Obviously, the speeds optimal for grinding operation depend on the diameter of the workpiece 102, the diameter and type of the grinding media and various other factors, and may be determined experimentally or by simulations, for example. Furthermore, in this step of moving forward the grinding wheel 104, the grinding wheel 104 is allowed to follow up-and-down fluctuations of the workpiece 102 based on a combinational use of at least the universal joint shaft 106-2, the spring 140 and the linear slide 142, as explained earlier with reference to FIGS. 2A and 2B.

In step 316, the rotations of the grinding wheel 104 and the workpiece 102 as well as the longitudinal advancement of the grounding wheel 104 are stopped when the predetermined internal surface area to be ground has been ground. In step 318, the grinding wheel 104 and the one or more rollers 122 are returned to their respective standby positions. In step 320, the workpiece 102 is dismounted from the grinding machine 100. After the grinding operation, inspections on the surface roughness may be conducted. If the surface roughness level does not meet predetermined criteria, hand grinding may be carried out, if necessary, to smoothen the surface for improving the quality.

Figure 8:
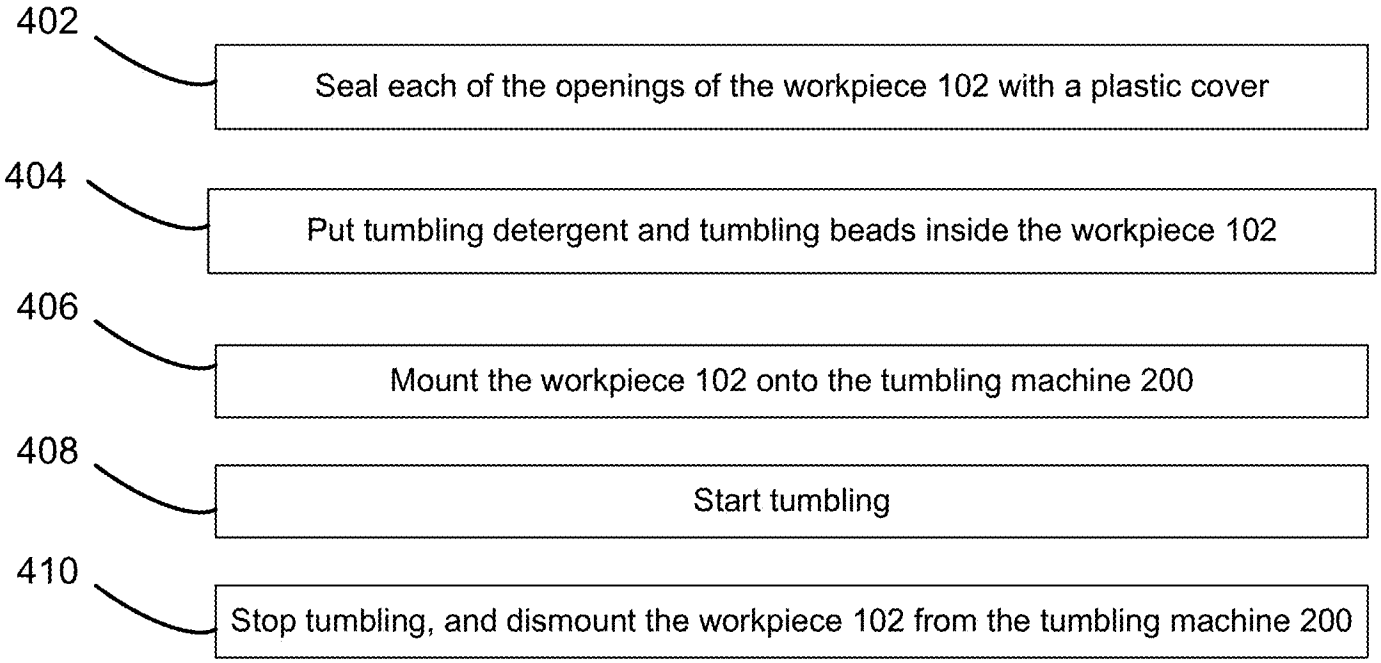
FIG. 8 is a flowchart illustrating an example procedure of the tumbling operation.

Additionally or alternatively to the hand grinding, the burnishing operation can be carried out by using the tumbling machine 200, as exemplified in FIGS. 6A and 6B. FIG. 8 is a flowchart illustrating an example procedure of the tumbling operation. In Step 402, each of the top and bottom openings of the workpiece 102, which has a generally hollow cylindrical shape, is sealed with a plastic cover. A fastening means such as a clamp or a band may be used to secure the plastic cover to the circular edge of the opening. In step 404, a tumbling detergent and tumbling beads are put inside the workpiece 102. An example procedure for this step 404 may include: cutting the plastic cover, throwing in the detergent and the beads through the cut, and sealing back the cut using an adhesive tape, for example. In step 406, the workpiece 102 with the tumbling detergent and beads therein is mounted onto the tumbling machine 200. In step 408, the tumbling is started. In step 410, after a predetermined period of time, the tumbling is stopped, and the workpiece 102 is dismounted from the tumbling machine 200. After the burnishing operation, inspections on the surface roughness may be conducted to quantify the surface quality.

Figure 9:
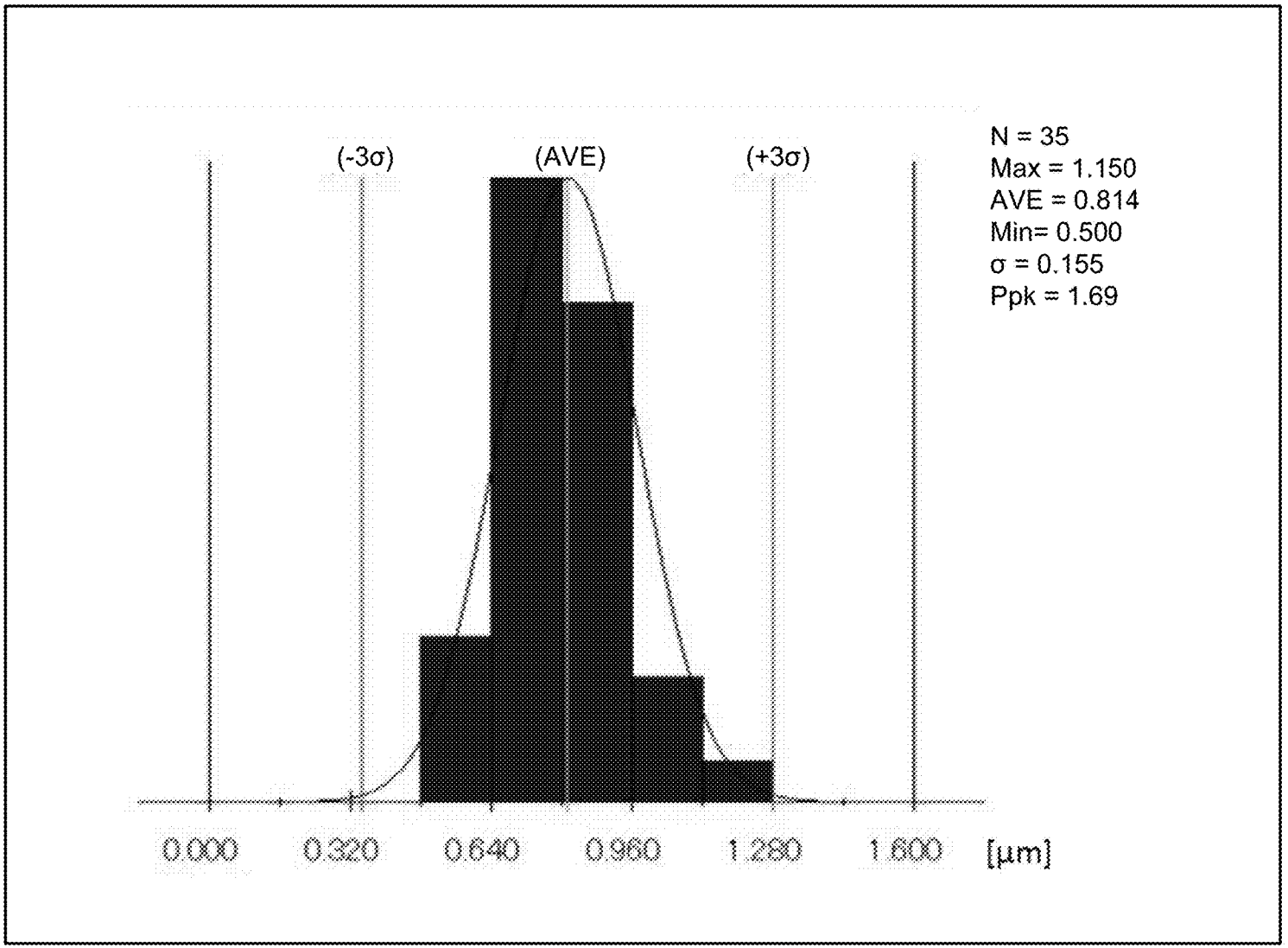
FIG. 9 shows a histogram and statistical results of the surface roughness.

FIG. 9 shows a histogram and statistical results of the surface roughness. The workpiece was a metal cylinder such as an aluminum liner. The data was obtained by measuring the surface roughness at 35 locations on the internal surface of the workpiece, ground and burnished based on the method described above in the flowcharts of FIGS. 7 and 8 by using the grinding machine 100, including the counter-weights 150 and the reinforcement involving three rails of the slide 116, and the tumbling machine 200. The average of the surface roughness in the present case is 0.814 μm, i.e., less than 1.0 μm, which is less than 50% of the average value of 2.0 μm, typically obtained for a workpiece polished by a conventional method such as hand polishing. The standard deviation (σ) is 0.155 μm, indicating a significantly small variation in surface roughness. The process performance index (Ppk) is 1.69, indicating a highly consistent process capability.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. A system for polishing an internal surface of a workpiece formed to be a generally cylindrical shell having a shape of a generally hollow cylinder, the system comprising a grinding machine comprising:

an arm coupled with a grinding wheel at one end portion, the grinding wheel including a grinding media for grinding the internal surface of the workpiece, the arm extending along its longitudinal axis that is in parallel with a cylindrical axis of the workpiece mounted on the grinding machine;

an arm rotation drive block comprising a first motor and coupled with the arm at the other end portion opposite to the one end portion with which the grinding wheel is coupled, to drive rotation of the arm around its longitudinal axis;

an arm movement drive block comprising:

an arm support for supporting and carrying the arm;

a second motor, a linear actuator and a slide configured for the arm support to engage with and slide along to move the arm longitudinally;

a jack to adjust a height of the arm support to adjust a vertical position of the arm, and a height gauge coupled with the arm support, wherein a vertical position of the grinding wheel with respect to the internal surface of the workpiece is adjusted by further adjusting the vertical position of the arm until the height gage shows a predetermined vertical shift; and a roller system comprising:

one or more rollers for rotating the workpiece around its cylindrical axis via friction between the one or more rollers and an external surface of the workpiece;

a third motor to drive rotation of the one or more rollers around their respective axes; and a pneumatic cylinder for adjusting a vertical position of the one or more rollers to bring the one or more rollers in contact with the external surface of the workpiece;

wherein a grinding operation is carried out by moving the grinding wheel forward at a predetermined speed by longitudinally moving the arm, while both the grinding wheel and the workpiece are rotating and the grinding media is in contact with the internal surface of the workpiece;

wherein the arm comprises a main shaft, a universal joint shaft, and a head section, the main shaft being fixed with the arm support, the universal joint shaft coupling the main shaft and the head section, and the head section being coupled with the grinding wheel;

wherein a spring and a linear slide are coupled with the head section, the linear slide being configured to provide the head section with free vertical motion; and wherein the head section oscillates vertically based at least on the universal joint shaft, the spring, and the linear slide, allowing the grinding wheel to vertically oscillate to follow up-and-down fluctuations of the internal surface of the workpiece, while the main shaft is fixed with the arm support.

2. The system of claim 1, wherein the spring is a gas spring.

3. The system of claim 1, wherein the grinding machine further comprises a counter-weight adjusting block comprising a plurality of weights and coupled with the arm support with which the main shaft is fixed, wherein a total weight provided by the counter-weight adjusting block is adjustable to enhance stability of the main shaft, thereby enhancing precision of the vertical oscillation of the grinding wheel with respect to the fixed main shaft to follow the up-and-down fluctuations of the workpiece.

4. The system of claim 1, wherein the slide in the arm movement drive block comprises a plurality of longitudinally formed rails, wherein two rails are configured for a bottom portion of the arm support to engage with and slide along, and a third rail is configured for a top portion of the arm support to engage with and slide along for enhancing stability of the main shaft, thereby enhancing precision of the vertical oscillation of the grinding wheel with respect to the fixed main shaft to follow the up-and-down fluctuations of the workpiece.

5. The system of claim 1, wherein the arm rotation drive block further comprises a first speed adjuster coupled between the first motor and the arm for changing a rotation speed from the first motor to the arm.

6. The system of claim 1, wherein the linear actuator in the arm movement drive block is a rack and pinion configured to convert a rotational motion of the pinion into a linear motion of the rack.

7. The system of claim 1, wherein the jack in the arm movement drive block is a hydraulic jack, wherein the vertical position of the arm is adjusted manually by using the hydraulic jack.

8. The system of claim 1, wherein the roller system further comprises a roller support to support and hold the one or more rollers and to slide vertically on vertically formed rails, wherein the vertical position of the one or more rollers is adjusted by the pneumatic cylinder disposed above the roller support.

9. The system of claim 1, wherein the roller system further comprises a second speed adjuster coupled between the third motor and the one or more rollers for changing a rotation speed from the third motor to the one or more rollers.

10. The system of claim 9, wherein the roller system further comprises a conveying device including pulleys and belts for conveying rotational energy provided by the third motor to the one or more rollers, the conveying device being coupled between the second speed adjuster and the one or more rollers.

11. The system of claim 1, further comprising:

a tumbling machine configured to rotate the workpiece including a tumbling detergent and tumbling beads therein around its cylindrical axis for burnishing the pre-ground internal surface of the workpiece.

12. A method of polishing an internal surface of a workpiece formed to be a generally cylindrical shell having a shape of a generally hollow cylinder by using the system of claim 1, the method comprising:

mounting the workpiece on the grinding machine so as to have the longitudinal axis of the arm in parallel with the cylindrical axis of the workpiece;

adjusting a longitudinal position of the grinding wheel with respect to an edge of the workpiece by longitudinally moving the arm manually or by running the second motor in the arm movement drive block;

adjusting a vertical position of the grinding wheel with respect to the internal surface of the workpiece by vertically moving the arm by using the jack in the arm movement block;

adjusting a vertical position of the one or more rollers to bring the one or more rollers in contact with the external surface of the workpiece by using the pneumatic cylinder in the roller system;

rotating the grinding wheel by running the first motor in the arm rotation drive block;

rotating the workpiece by rotating the one or more rollers, based on friction between the one or more rollers and the external surface of the workpiece, by running the third motor in the roller system;

moving forward the grinding wheel at a predetermined speed by longitudinally moving the arm by running the second motor in the arm movement drive block; and stopping the rotation of the grinding wheel, the rotation of the workpiece, and the forward movement of the grinding wheel upon completion of grinding a predetermined internal surface area of the workpiece, wherein the adjusting the vertical position of the grinding wheel comprises further adjusting the vertical position of the grinding wheel with respect to the internal surface of the workpiece by further vertically moving the arm, until the height gage coupled with the arm support shows the predetermined vertical shift, wherein the moving forward the grinding wheel comprises allowing the grinding wheel to vertically oscillate to follow up-and-down fluctuations of the internal surface of the workpiece, by allowing the head section to oscillate vertically based at least on the universal joint shaft, the spring, and the linear slide, while the main shaft is fixed with the arm support.

13. The method of claim 12, wherein the system further comprises a tumbling machine, wherein the method further comprises, after the stopping, rotating the workpiece around its cylindrical axis using the tumbling machine, the workpiece including a tumbling detergent and tumbling beads therein, for burnishing the pre-ground internal surface of the workpiece.

14. The method of claim 12, wherein the grinding machine further comprises a counter-weight adjusting block comprising a plurality of weights and coupled with the arm support, wherein the method further comprises:

adjusting a total weight provided by the counter-weight adjusting block to enhance stability of the main shaft fixed with the arm support, thereby enhancing precision of the vertical oscillation of the grinding wheel with respect to the fixed main shaft to follow the up-and-down fluctuations of the workpiece.

15. The method of claim 12, wherein the slide comprises a plurality of longitudinally formed rails, wherein two rails are configured for a bottom portion of the arm support to engage with and slide along, and a third rail is configured for a top portion of the arm support to engage with and slide along, wherein the moving forward the grinding wheel at the predetermined speed by longitudinally moving the arm by running the second motor in the arm movement drive block comprises using the plurality of longitudinally formed rails for the arm support to engage with and slide along, wherein the third rail enhances stability of the main shaft fixed with the arm support, thereby enhancing precision of the vertical oscillation of the grinding wheel with respect to the fixed main shaft to follow the up-and-down fluctuations of the workpiece.

16. A metal cylinder polished by using the method of claim 12, the method further comprising burnishing the pre-ground internal surface of the metal cylinder, wherein an average value of surface roughness of the internal surface of the metal cylinder is less than 50% of an average value of surface roughness of an internal surface of a metal cylinder polished by hand polishing.

* * * * *